US005839893A

United States Patent [19]

Leibling

[11] Patent Number: 5,839,893

[45] Date of Patent: Nov. 24, 1998

[54] HOT BURNING NOZZLE WITH A CHANGE PIPE

[75] Inventor: Udo Leibling, Bingen, Germany

[73] Assignee: Agrichema Materialflusstechnik GmbH, Germany

[21] Appl. No.: 860,708

[22] PCT Filed: Nov. 11, 1996

[86] PCT No.: PCT/EP96/04928

§ 371 Date: Jul. 17, 1997

§ 102(e) Date: Jul. 17, 1997

[87] PCT Pub. No.: WO97/19309

PCT Pub. Date: May 29, 1997

[30] Foreign Application Priority Data

Nov. 17, 1995 [DE] Germany ..... 295 18 283.0

[51] Int. Cl.[6] ..... F27D 23/00

[52] U.S. Cl. ..... 432/75; 432/2; 110/182.5

[58] Field of Search ..... 432/75, 2; 110/182.5, 110/335

[56] References Cited

U.S. PATENT DOCUMENTS

| | | | |
|---|---|---|---|
| 3,166,621 | 1/1965 | Carlson | 110/182.5 |
| 3,558,119 | 1/1971 | Demalander | 110/182.5 |
| 4,586,895 | 5/1986 | Battles | 432/2 |
| 5,178,819 | 1/1993 | Schoennahl | 110/182.5 |

FOREIGN PATENT DOCUMENTS

| | | |
|---|---|---|
| 0 070 799 | 7/1982 | European Pat. Off. . |
| 0 566 940 A1 | 4/1993 | European Pat. Off. . |
| 9201690 U | 8/1992 | Germany . |
| WO 96/21132 | of 0000 | WIPO . |
| WO 96/33380 | 10/1996 | WIPO . |

*Primary Examiner*—Teresea J. Walberg
*Assistant Examiner*—Jiping Lu
*Attorney, Agent, or Firm*—Vanophem Meehan & Vanophem, P.C.

[57] ABSTRACT

A device enabling air-blast nozzles to be replaceably mounted in the walls of reaction chambers, or ovens used for processing materials, in order to remove material caked or accumulated on the inside surface of the walls (2). Fitted in the wall (2) is an exchangeable pipe (1) which extends from the outside through part of the wall towards the inside surface, a nozzle (5) being mounted at the oven end of the pipe.

13 Claims, 4 Drawing Sheets

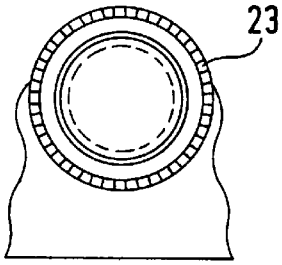
FIG. 3c
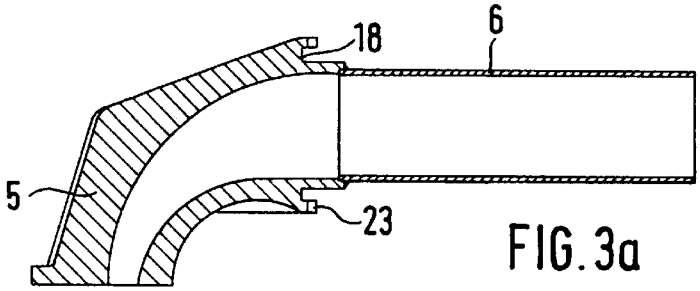
FIG. 3a
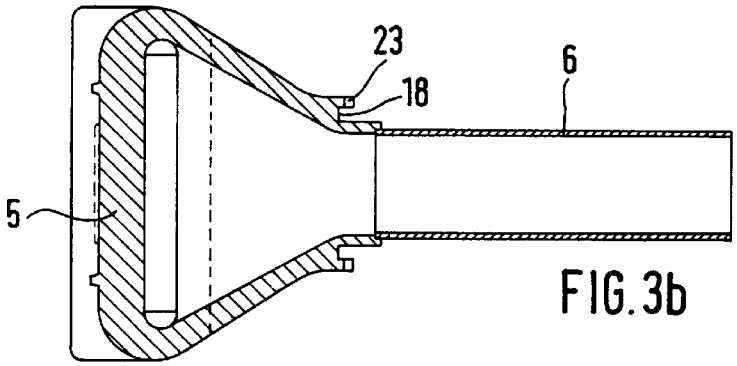
FIG. 3b
FIG. 4a
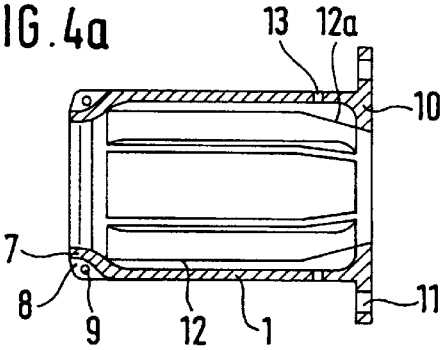
FIG. 4b
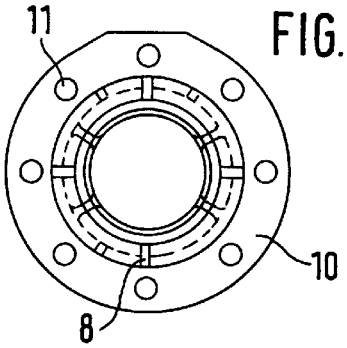
FIG. 5a
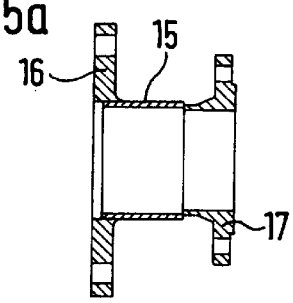
FIG. 5b
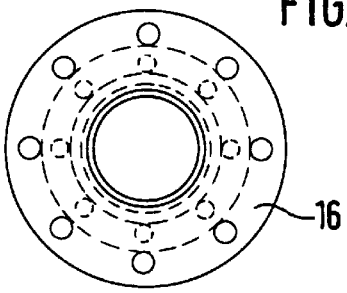

HOT BURNING NOZZLE WITH A CHANGE PIPE

BACKGROUND OF THE INVENTION

1. Field of the Invention

This invention relates to hot burning nozzles.

2. Description of the Prior Art

The use of hot burning nozzles for detaching cakings in industrial furnaces, such as cement kilns and the like, has proven useful for years. Hot burning nozzles made, for example, of casting material are embedded in openings in the masonry of an industrial furnace and backfilled with refractory material so as to ensure a reliable seat in the masonry. The end of the hot burning nozzle protruding outside the furnace is normally welded for attachment and blowback protection to a box mounted on the furnace's outside wall through which the hot burning nozzle protrudes and which is in turn welded to the outside casing of the furnace or chambers which is normally made of a metal material. The hot burning nozzle as such embodies a mouthpiece protruding into the furnace, and an outside piece protruding outside through the furnace wall to be connected with an air blast device, the two single parts being interconnected in a way incorporated into the material, i.e. by a weld. This weld is normally located in the masonry with conventional furnace wall thicknesses and known hot burning nozzles. By reason of chemical components of the masonry this can lead to negative influences on the weld which lead to accelerated corrosion and thus to reduced service life of the hot burning nozzles. It is very troublesome to change a corroded or worn-out hot burning nozzle of this kind since it is installed directly in the masonry and the furnace masonry must be broken open, which is time-consuming and expensive.

In order to remedy these disadvantages one eventually began replacing the above-described weldment with hot burning nozzles wherein the piece of pipe protruding outside beyond the furnace wall is integrally cast on the mouthpiece protruding inside the furnace. Although such a construction avoids a corrodible weld within the masonry, the problem remains that it is extremely troublesome to replace worn-out hot burning nozzles. The masonry must still be broken open around the hot burning nozzle and the outwardly protruding piece of pipe of the nozzle must be burned away from the attachment box mounted on the furnace's outside wall. In addition, with this hot burning nozzle, as with the first mentioned one, one must remove and replace the entire device, including the mouthpiece and the outwardly protruding pipe, for connection with an air blast device, even though the main wear in hot burning nozzles normally occurs on the mouthpiece directed toward the interior of the furnace so that it would normally suffice to replace this mouthpiece to restore the operability and efficiency of a hot burning nozzle.

These findings led to the development of hot burning nozzles in a change box (EP 555 725 A1) wherein the mouthpiece of the hot burning nozzle and an optional intermediate piece for connection with an outwardly protruding connection pipe are received within a change box embedded firmly in the furnace masonry. The change box is sealed from the furnace's outer side with a screwed plate which is provided with a pipe protruding therethrough for connecting the hot burning nozzle with an air blast device and fixes the mouthpiece and an optional intermediate piece of the hot burning nozzle in the change box in the installed state. However, the advantage of extremely simple replacement of worn-out hot burning nozzle elements in this concept is opposed by a very high weight of the hot burning nozzle mouthpieces to be inserted into the change box, which is due to the fact that the hot burning nozzle mouthpieces to be inserted into the change box must be provided with suitable stop surfaces, such as flanges and ribs, to ensure a reliable seat within the change box and absorb the high blowback forces occurring during operation of the hot burning nozzles. The advantages are opposed by the high weight of the spare parts which makes it difficult to handle these parts during replacement, apart from the fact that the quantity of material necessary for producing them is comparatively cost-intensive.

A need therefore exists for hot burning nozzles which permit the advantages of hot burning nozzles in a change box, i.e. simple replacement of only the worn-out parts of the hot burning nozzle, while being of simple structure and having a smaller space requirement and reduced weight.

SUMMARY OF THE INVENTION

The present invention provides a hot burning nozzle to be installed in industrial furnaces. The nozzle has wearing parts that can be easily replaced, is of simple structure and has low weight.

According to the invention one provides a hot burning or expanding guide nozzle which can have a straight blow-off angle but preferably a 90% offset one. The inventive hot burning nozzle consists of a change pipe which is inserted into a furnace wall and held by a flat iron ring on the sheet steel wall surrounding the furnace wall, the flat iron ring being welded both to the change pipe and to the sheet steel wall. In the inserted state the change pipe therefore protrudes a certain extent outwardly beyond the sheet steel wall of the furnace, a welded-on or integrally cast connection flange with a suitable number of through bores therein being provided on this outwardly protruding end of the change pipe. In the opposite direction the change pipe protrudes into the masonry of the furnace wall in the inserted state, the change pipe end protruding inside the furnace preferably extends approximately up to half the masonry wall thickness and ends in a wall cavity or recess on the furnace's inner side.

The diameter of the change pipe is preferably constricted at its end pointing inside the furnace, whereby circumferentially distributed, preferably U-shaped brackets, possibly having a bore, are provided between the outside edge of the constricted diameter and the outside edge of the change pipe.

On its inside diameter the change pipe is equipped with preferably six ribs which serve to stabilize the change pipe by removing the wall loads, on the one hand, and have a guide function for pipes introduced into the change pipe from the interior of the furnace, on the other hand. Between the ribs in the area of the change pipe protruding outwardly beyond the furnace wall one can provide bores, preferably six in number, which can serve to passively ventilate the interior of the change pipe, on the one hand, and also actively ventilate the interior of the change pipe and the nozzle parts disposed in the change pipe, on the other hand. The resulting ventilation reduces the nozzle mouthpiece temperatures, thereby their susceptibility to wear is also considerably reduced.

Furthermore the inventive hot burning nozzle is provided with a short nozzle mouthpiece whose fitting depth corresponds to the distance between the furnace's inside wall and the change pipe end protruding into the furnace wall. The nozzle mouthpiece is preferably made of chrome nickel cast steel since this material shows behavioral advantages with respect to heat and wear. Welded to the short nozzle mouthpiece is a preferably heatproof pipe which is inserted from the interior of the furnace into the change pipe fastened in the furnace wall and has a length such that its free end protrudes beyond the change pipe. The nozzle mouthpiece can thus be kept very short and has a low individual weight so that it can be replaced cost-effectively as an expendable part despite the special choice of material. The welded-on change pipe can be separated directly behind the weld and welded to a new nozzle mouthpiece. Due to the threaded length on the pipe or nut, the pipe can be used repeatedly, in particular for at least three hot burning nozzles. The end of this pipe protrudes outwardly beyond the change pipe and preferably bears an outside thread, which may be a four-inch outside thread or another suitable thread. The weld between the nozzle mouthpiece and the pipe is located within the change pipe, after installation, to avoid chemical action of the masonry on the weld.

The end of the short nozzle mouthpiece pointing to the change pipe is formed such that this nozzle end engages the change pipe end protruding toward the furnace's inside wall. For this purpose the end of the nozzle mouthpiece that points to the change pipe is provided with teeth or a toothed ring that engages, in the installed state, the brackets provided on the constricted end of the change pipe, so that the nozzle mouthpiece is locked and prevented from rotating in the installed state. This permits different pressure positions of the nozzle mouthpiece relative to the change pipe. In addition, the end of the nozzle mouthpiece pointing inside the furnace is provided with a recess, preferably a circumferential groove, which the constricted circumference of the change pipe end pointing inside the furnace engages when the hot burning nozzle is installed. In addition a preferably refractory round seal is advantageously inserted into this groove to ensure a gastight seal between the change pipe and nozzle mouthpiece.

In the installed state of the hot burning nozzle on the change pipe there is a unit screwed onto the end of the hot burning nozzle protruding outwardly beyond the change pipe of the heatproof pipe welded to the nozzle mouthpiece. The unit is a threaded sleeve provided with a smooth flange with through bores for a bracing screw joint with the outwardly protruding flange of the change pipe, and has fastened to the other end a welding neck flange for connection with an air blast device. One can use a weldment here or, alternatively, produce a complete unit made, for example, of injection molded aluminum or the like. The threaded sleeve unit is screwed onto the outside thread of the pipe welded to the nozzle mouthpiece and tightened until a sealing connection by external force occurs between the nozzle mouthpiece and the change pipe. The screw joint bracing the change pipe and nozzle mouthpiece is then locked with the aid of screw bolts in the through bores in the flanges on the threaded sleeve as well as on the change pipe, so that no creeping detachment of the joint can occur during operation of the hot burning nozzles.

When the hot burning nozzle is locked within the change pipe in the above-described way, the remaining recess in the furnaces inside wall is filled around the inserted nozzle mouthpiece with refractory material, whereupon the hot burning nozzle is ready for use.

While with conventional hot burning nozzles installed directly in the furnace wall one must chisel out the entire furnace wall thickness up to the external sheet steel wall and later put it back again to replace worn-out hot burning nozzles, this is only necessary in the mouthpiece area with the hot burning nozzle according to the invention. In the present invention, the change pipe remains in the inserted state and only the nozzle mouthpiece with the welded-on heatproof pipe is replaced. This not only advantageously facilitates the replacement work for hot burning nozzles but also avoids damage to the masonry surrounding the hot burning nozzles which can occur in the form of stress cracks when the furnace walls are completely opened with a chisel.

Compared to the hot burning nozzle in a change box, the inventive apparatus is a much simpler structure and has lighter single parts while worn-out parts are easy to replace.

In order to make it even easier to replace the hot burning nozzle mouthpiece according to the present invention, it is also possible to provide the hot burning nozzles with a casing of refractory bricks that can be inserted into suitably formed recesses around the fitting position of the nozzle. The refractory bricks for encasing the nozzle can be hung with suitable anchors in the above-described bores in the brackets distributed along the circumference of the constricted diameter of the change pipe and the joints filled with refractory material. When the nozzle mouthpiece with the welded-on heatproof pipe is to be replaced, one then need only take out those refractory bricks which protrude beyond the nozzle toward the inside of the furnace to protect the nozzle from the effects of heat. One can facilitate the replacement of hot burning nozzle mouthpieces further by connecting these last mentioned refractory bricks directly with the nozzle mouthpiece and replacing them. The operations necessary for replacing the nozzle mouthpieces are therefore reduced according to the present invention to loosening the corresponding refractory bricks surrounding the nozzle and unscrewing the threaded sleeve bracing the unit, whereupon one can take the nozzle with the welded-on heatproof pipe out of its installed seat in a simple and advantageous way.

In the case of offset nozzle mouthpieces it is advantageous to provide a reinforcement on the face of the nozzle mouthpiece pointing inside the furnace for fixing refractory material for thermal protection of the nozzle mouthpiece. This reinforcement advantageously embodies a honeycomb lattice produced from individual suitably folded metal strips interconnected in shape-mated fashion. The refractory material can be applied either before or after the nozzle mouthpiece is installed.

Further objects, features, and advantages of the invention will become apparent from a reading of the following detailed description of the preferred embodiment taken in conjunction with the accompanying drawings.

BRIEF DESCRIPTION OF THE DRAWINGS

FIGS. 3*a* to 3*c* show the mouthpiece of the hot burning nozzle of FIG. 1 with a welded-on pipe;

FIGS. 4*a* and 4*b* show the change pipe of FIG. 1 in different perspectives;

FIGS. 5*a* and 5*b* show a threaded sleeve of FIG. 1 in different perspectives.

DETAILED DESCRIPTION OF THE PREFERRED EMBODIMENT

Figure 1:
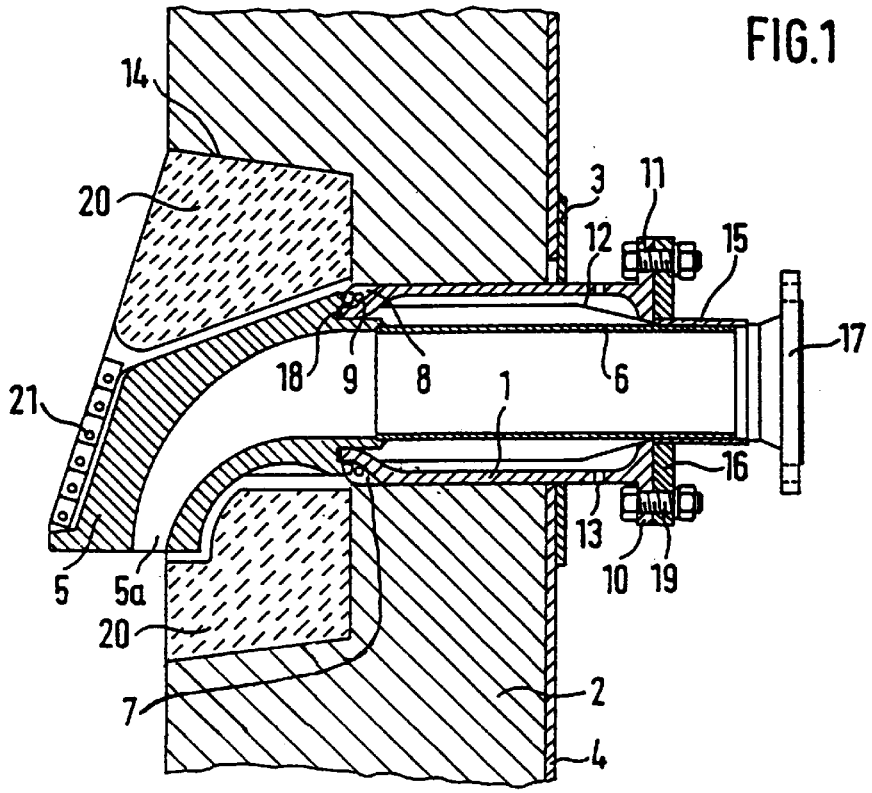
FIG. 1 is a cross-sectional view of one embodiment of the hot burning nozzle installed in accordance with the present invention.

FIG. 1 shows the embodiment of a hot burning nozzle in the installed situation. A change pipe 1 is seated in a furnace wall 2 and welded via a flat iron ring 3 to a sheet steel wall 4 surrounding the outer side of the furnace wall 2. The change pipe end located approximately in the middle of the furnace wall 2 is depicted as reduced area 7. Between the outside edge of the constricted diameter 7 and the outside edge of the change pipe there are brackets 1 each provided with a bore 9. Four brackets 8 with bores 9 are preferably distributed along the circumference of the constricted area 7. On the outwardly protruding end of the change pipe 1 there is a flange 10 in the shown embodiment which can be welded on or integrally cast. The flange is provided with through bores 11. In the interior of the change pipe 1 ribs 12 are distributed around the inner circumference that serve firstly to stiffen the change pipe 1 and, due to their sloping in the direction of the outwardly pointing change pipe opening, also have a guide function for pipes 6 inserted into the change pipe. Between the ribs 12 distributed around the inner circumference of the change pipe there are bores 13 which can serve to passively ventilate the interior of the change pipe during operation of the hot burning nozzle, on the one hand, and can also be connected with a compressed air device for example, on the other hand, so that active cooling of the interior of the change pipe takes place during operation of the nozzle. As illustrated, toward the inside of the furnace, the change pipe 1 ends in a recess 14 on the inner side of the furnace wall 2. Mounted on the change pipe is a nozzle mouthpiece 5, here offset 90°, the change pipe 1 being inserted into the furnace wall 2 such that a nozzle outlet 5*a* ends precisely with the furnaces inner side. Welded to the end of the nozzle mouthpiece 5 inserted into the change pipe is a heatproof pass-through pipe 6 whose length is such that it extends outwardly beyond the change pipe. On the end extending beyond the change pipe 1 of the heatproof pipe 6 welded to nozzle mouthpiece 5 is an outside thread, not shown. Screwed onto the outside thread of the pipe 6, which is preferably a four-inch thread, to fix the nozzle mouthpiece with welded-on heat-proof pipe 6 on or in the change pipe 1 is a threaded sleeve 15 which is provided in the direction of the change pipe with a flange 16 and in the direction opposite the change pipe with a weld-on flange 17 for connection with an air blast device. The threaded sleeve 15 with flanges 16 and 17 can be produced as a weldment, on the one hand, or integrally, for example by aluminum casting, on the other hand. After the threaded sleeve 15 is tightened, the nozzle mouthpiece 5 with welded-on pipe 6 is held by external force in the change pipe 1, whereby the constricted end 7 of the change pipe 1 engages a groove 18 provided on the nozzle mouthpiece end on the change pipe side, a refractory round seal (not shown) optionally being inserted into the groove 18. A toothed ring 23 (shown in FIGS. 3*a*–3*c* and explained below) is preferably provided on the end of the nozzle mouthpiece 5 on the change pipe side to engage the brackets 8 provided on the constricted circumference 7 of the change pipe 1 when the nozzle mouthpiece is installed in the change pipe 1, so that the nozzle mouthpiece 5 cannot rotate relative to the change pipe 1. When the threaded sleeve 15 is screwed onto the outside thread on the pipe 6 welded to the nozzle mouthpiece 5 and tightened, the threaded sleeve is locked by screw bolts 19 inserted into the through bores 11 in the change pipe flange 10 and the through bores in the flange 16 of the threaded sleeve 15. The screw bolts 19 permit the nozzle mouthpiece with welded-on heatproof pipe 6 to be fixed by external force in the change pipe 1 even when the threaded sleeve 15 is not tightened as far as the stop of the threaded sleeve flange 16 and the change pipe flange 10. In the illustrated embodiment, the nozzle mouthpiece 5 is surrounded in the installed state by refractory bricks 20 whose shape is adapted to the recess 14 in the furnace wall 2 and also to the contours of the dimensions of the nozzle mouthpiece 5. The shown spaces between the nozzle mouthpiece and the shaped bricks are filled during operation with refractory jointing cement. As illustrated, to replace the nozzle mouthpiece 5 with its welded-on heatproof pipe 6 one need only loosen and take out the upper refractory brick 20, whereupon one can easily remove the nozzle mouthpiece and welded-on pipe 6 from the change pipe 1, after detachment of the threaded sleeve 15, and replace it with a new nozzle mouthpiece. Worn-out nozzle mouthpieces 5 can therefore be replaced simply and quickly without requiring an elaborate change box construction. To protect the wall of the nozzle mouthpiece 5 on the furnace side one provides a reinforcement 21 thereon, which, in the shown embodiment, is in the form of a honeycomb lattice, in particular of individual folded sheet metal strips interconnected at the connecting points in shape-mated fashion or in a way incorporated into the material. Applied to this reinforcement in the installed state of the nozzle mouthpiece is refractory material which is held and protected from flaking off by the reinforcement. The refractory material is expediently disposed on a bar formed in the area of the mouth opening of the nozzle mouthpiece 5 and pointing inside the furnace.

Figure 1A:
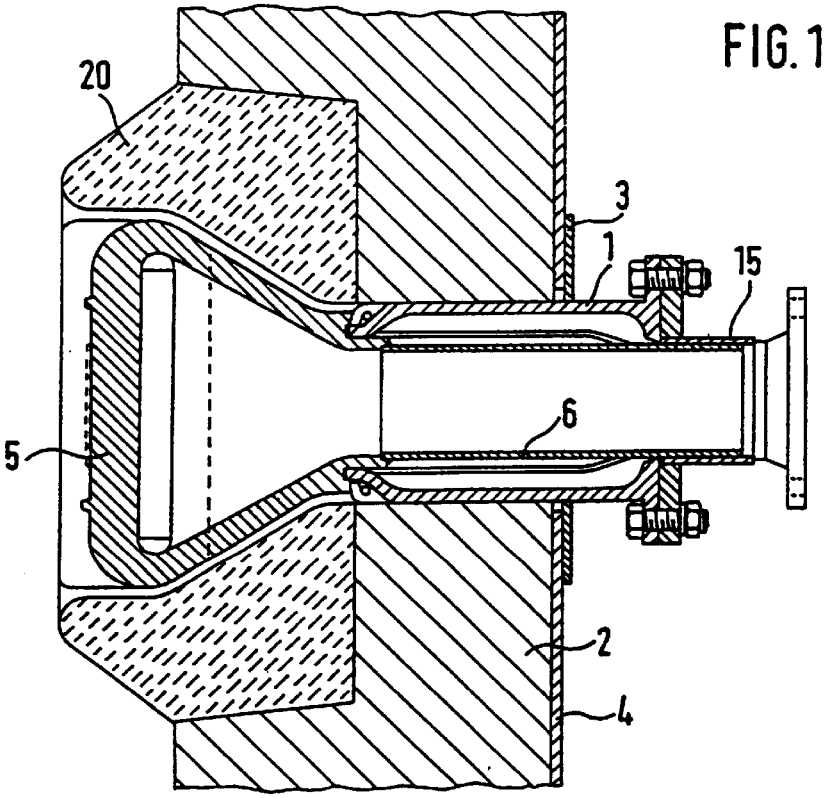
FIG. 1*a* is a plan view of the hot burning nozzle of FIG. 1.

FIG. 1*a* is a cross-sectional plan view of the embodiment of FIG. 1. In this view one can clearly see the adaptation of the refractory bricks 20 to the contour of nozzle mouthpiece 5.

Figure 2:
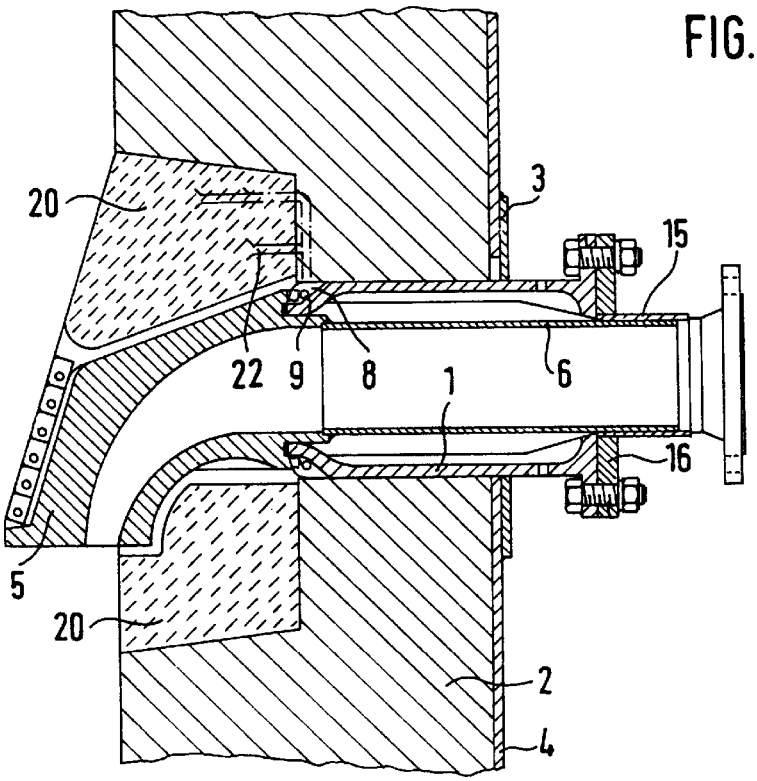
FIG. 2 is a cross-sectional view of a variation of the hot burning nozzle of FIG. 1 with shaped bricks anchored on the change pipe.
Figure 2A:
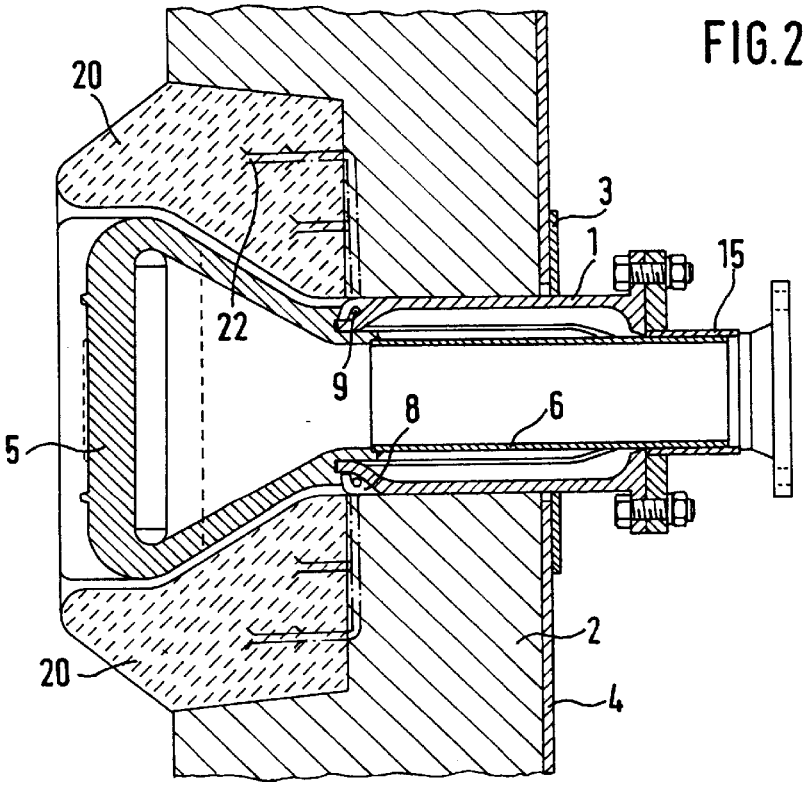
FIG. 2*a* is a plan view of the hot burning nozzle of FIG. 2.

FIGS. 2 and 2*a* illustrate an alternate embodiment of the hot burning nozzle of FIGS. 1 and 1*a*, wherein the refractory bricks 20 surrounding the nozzle mouthpiece 5 in the installed state in the furnace wall 2 are provided with anchors 22 which facilitate attachment of the refractory bricks 20 in their position surrounding the nozzle mouthpiece 5. The refractory bricks 20 need only be hung in the bores 9 in the brackets 8 on the change pipe 1 with the aid of the anchors 22 in the installed state. Accordingly, it is easy to take out the refractory bricks 20 when it is necessary to change the nozzle mouthpiece 5 and welded-on pipe 6.

FIGS. 3*a*, 3*b* and 3*c* illustrate the hot burning nozzle mouthpiece 5 and the welded-on pipe 6 in the dismounted state. One can clearly see the circumferential groove 18 provided on the end of the nozzle mouthpiece 5 on the change pipe side for engagement with the constricted diameter 7 of the change pipe 1. In addition, FIGS. 3*a* to 3*c* very clearly show the toothed ring 23 formed around the groove 18, its teeth serving to engage the brackets 8 of the change pipe 1 in the installed state of the nozzle mouthpiece 5 so as to prevent rotation relative to the change pipe.

FIGS. 4*a* and 4*b* show the change pipe of FIGS. 1 and 2 as a single part. This view of the change pipe 1 illustrates the arrangement of the ribs 12 distributed along the inner circumference of the change pipe 1 and the formation of guide slopes 12*a* on the ribs 12 which serve to guide the pipe 6 upon its introduction into the change pipe 1.

FIGS. 5*a* and 5*b* illustrate the threaded sleeve 15 of the embodiment of FIG. 1, including the flange 16 on the change pipe side and the weld-on flange 17 disposed on the other side of threaded sleeve 15 for connection with an air blast device (not shown).

Figure 6:
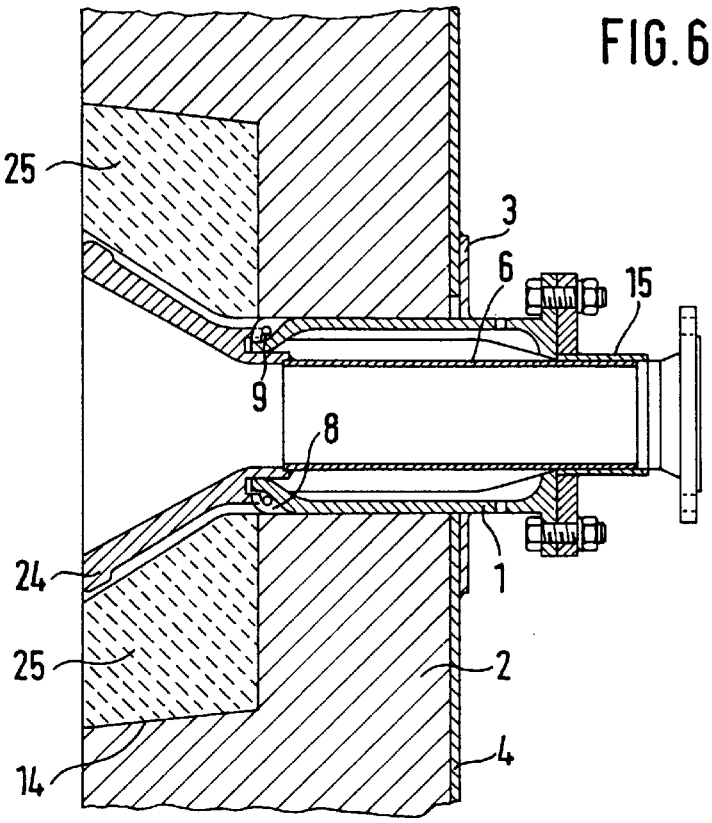
FIGS. 6 and 6*b* show a further embodiment of a hot burning nozzle in different sectional views.
Figure 6B:
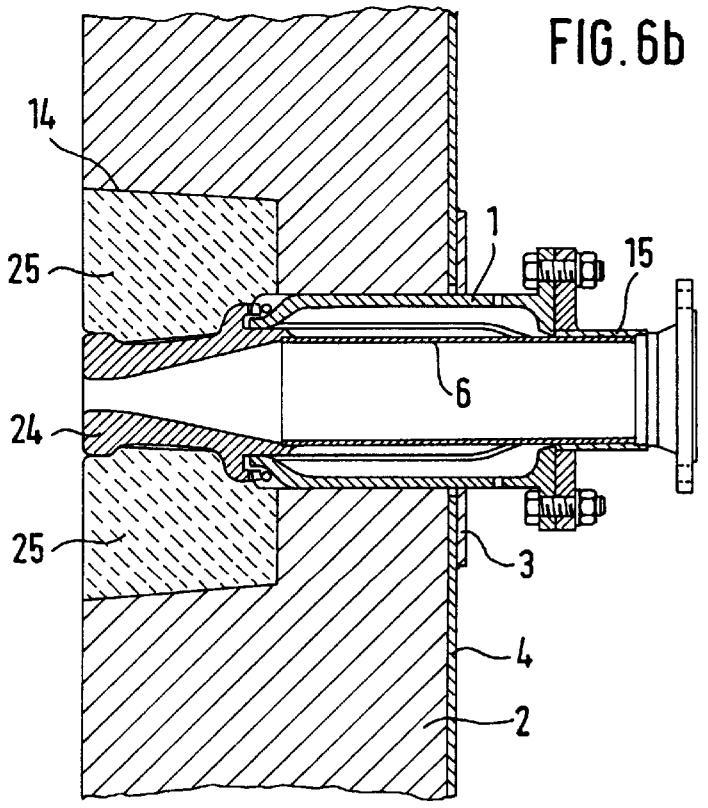

FIGS. 6 and 6*b* show a further embodiment of a hot burning nozzle with change pipe 1. The crucial difference over the embodiments shown in FIGS. 1 and 2 is the alignment of a nozzle mouthpiece 24 and the shape of refractory bricks 25 surrounding it. The other elements, including the change pipe 1 and the pipe 6 welded to the nozzle mouthpiece, correspond to the elements from the embodiments of FIGS. 1 and 2. It is therefore possible to use different nozzle mouthpieces with one and the same change pipe. The refractory bricks 25 of the embodiment shown in FIGS. 6 and 6*b* can, like the refractory bricks 20 of FIG. 2, be provided with anchors which permit attachment of the refractory bricks in the bores 9 of the brackets 8 on the change pipe 1. In this embodiment the joints between the nozzle mouthpiece 24 and the refractory bricks 25 are also filled with a refractory jointing cement during operation of the nozzle. Instead of shaped bricks 25 one can also use simple refractory materials for filling the recess 14 in the furnace wall 2, which one removes when replacing the nozzle mouthpiece 24 and the welded-on heatproof pipe 6.

In addition to the individual embodiments of hot burning nozzles shown, it is also possible to combine the various features of the embodiments in suitable and advantageous fashion.

What is claimed:

1. An apparatus for replaceably disposing a hot burning or expanding guide nozzle mounted in a wall of an industrial reaction chamber or a furnace, said furnace wall having a thickness, an inner side and an outer side, said nozzle removing cakings and bankings of material build-up on the inside wall of said furnace by the use of an air blast device, said apparatus comprising:

a change pipe disposed in said furnace wall, said change pipe having one end extending from said outer side of said furnace wall and an opposite end extending over part of said thickness of said furnace wall toward said inner side of said furnace wall;

a nozzle mouthpiece mounted in said wall and having one end attached to said opposite end of said change pipe, said nozzle mouthpiece further having a pass-through pipe extending from said one end of said nozzle mouthpiece through said change pipe and through and past said outer side of said furnace wall in a direction away from said inner side for connection with said air blast device, the end of said pass-through pipe extending beyond said change pipe and being provided with a threaded portion; and a sleeve threadably connected to said threaded portion of said pass-through pipe for fixing said nozzle mouthpiece and pass-through pipe with respect to said change pipe.

2. The apparatus of claim 1 wherein said inner side of said furnace wall further comprises a recess and said change pipe extends at least to said recess in said inner side of said furnace wall, said nozzle mouthpiece being located in said recess and further comprising refractory means mounted in said recess and surrounding said nozzle mouthpiece to substantially backfill said recess.

3. The apparatus of claim 1 wherein said opposite end of said change pipe engages said one end of said nozzle mouthpiece, said opposite end of said change pipe engaging said one end of said nozzle mouthpiece along the circumferential periphery thereof.

4. The apparatus of claim 3 further comprising a groove located in said one end of said nozzle mouthpiece; and a heatproof seal located in said groove of said nozzle mouthpiece.

5. The apparatus of claim 1 wherein said change pipe further comprises a reduced circumference at said opposite end, and wherein said apparatus further comprises a plurality of brackets and a plurality of teeth, having alternating recesses, said plurality of brackets between said opposite end of said change pipe and said end of said nozzle mouthpiece, said plurality of brackets being distributed around said circumference, said plurality of brackets, mating with said plurality of teeth at said one end of said nozzle mouthpiece to engage said change pipe to said nozzle mouthpiece.

6. The apparatus of claim 1 further comprising a plurality of longitudinal ribs distributed circumferentially around the inside of said change pipe, each of said longitudinal ribs having a sloped surface tapered toward the outer side of said furnace wall.

7. The apparatus of claim 1 further comprising a plurality of bores in said change pipe for ventilating said change pipe.

8. The apparatus of claim 1, further comprising a plurality of refractory bricks surrounding said mouthpiece nozzle on said inner side of said furnace wall.

9. The apparatus of claim 8 wherein said plurality of refractory bricks have anchors mounted to said plurality of bores of said change pipe.

10. The apparatus of claim 8 wherein said plurality of refractory bricks have anchors mounted to said nozzle mouthpiece.

11. The apparatus of claim 1 wherein said nozzle mouthpiece has a 90° offset and a refractory material is disposed on said nozzle mouthpiece inside said furnace wall.

12. The apparatus of claim 11 further comprising a reinforcement for fixing said refractory material to said inner side of said furnace wall.

13. The apparatus of claim 12 wherein said reinforcement is a lattice of interconnected folded metal strips.

* * * * *

UNITED STATES PATENT AND TRADEMARK OFFICE

CERTIFICATE OF CORRECTION

PATENT NO. : 5,839,893
DATED : November 24, 1998
INVENTOR(S) : Udo Leibling

It is certified that error appears in the above-identified patent and that said Letters Patent is hereby corrected as shown below:

Column 3, line 60, kindly delete "furnaces" and insert ---- furnace's ----.

Column 5, line 13, kindly delete numeral "1" and insert ---- 8 ----.

Column 5, line 36, kindly delete "furnaces" and insert ---- furnace's ----.

Column 5, line 41, after "to" kindly insert ---- the ----.

Column 8, line 11, kindly delete "circum-".

Column 8, line 12, kindly delete "ferential"; same line kindly delete "thereof" and insert ---- of said one end of said nozzle mouthpiece.

Signed and Sealed this

Twenty-second Day of June, 1999

*Attest:*

Q. TODD DICKINSON

*Attesting Officer*

*Acting Commissioner of Patents and Trademarks*